US005418404A

United States Patent [19]

Araoka et al.

[11] Patent Number: 5,418,404

[45] Date of Patent: May 23, 1995

[54] DATA PROCESSING DEVICE AND PLUG-IN PACKAGE

[75] Inventors: Manabu Araoka, Hitachi; Yoshiaki Takahashi, Mito; Atsushi Shikama; Yoshihiro Miyazaki, both of Hitachi; Tomoaki Nakamura, Katsuta; Masayuki Sakata, Takahagi, all of Japan

[73] Assignees: Hitachi, Ltd.; Hitachi Process Computer Engineering, Inc., both of Tokyo, Japan

[21] Appl. No.: 260,367

[22] Filed: Jun. 14, 1994

Related U.S. Application Data

[62] Division of Ser. No. 808,610, Dec. 17, 1991, Pat. No. 5,343,009.

[30] Foreign Application Priority Data

Dec. 17, 1990 [JP] Japan ..... 2-402717

[51] Int. Cl.[6] ..... H01R 13/707

[52] U.S. Cl. ..... 307/142; 200/50 A; 200/50 AA; 200/322; 361/609; 361/615; 439/62; 439/188

[58] Field of Search ..... 200/50 A, 50 AA, 43.11, 200/43.16, 51 LM, 318, 321-324; 361/609, 615, 339, 343, 415, 608, 798, 796, 797; 211/41; 439/59, 62, 188, 157, 329, 152, 153, 377, 310; 24/41; 307/142

[56] References Cited

U.S. PATENT DOCUMENTS

| | | | |
|---|---|---|---|
| 3,932,716 | 1/1976 | Mottel et al. | 361/339 |
| 4,071,722 | 1/1978 | Hart | 361/339 |
| 4,268,729 | 5/1981 | Gaizauskas | 200/50 B |
| 4,313,150 | 1/1982 | Chu | 361/415 |
| 5,033,972 | 7/1991 | Komatsu et al. | 439/377 |

FOREIGN PATENT DOCUMENTS

| | | |
|---|---|---|
| 51-108519 | 9/1976 | Japan . |
| 59-31240 | 7/1984 | Japan . |
| 63-153899 | 6/1988 | Japan . |

*Primary Examiner*—A. D. Pellinen
*Assistant Examiner*—Jonathan Kaplan
*Attorney, Agent, or Firm*—Antonelli, Terry, Stout & Kraus

[57] ABSTRACT

In a data processing device, when exchanging a plug-in package with another without breaking the power to be supplied to the data processing device, a package removing lever is equipped with a locking piece. The lever does not move and the package hence cannot be removed, until the locking piece is released. In response to the release operation of the locking piece, a switch is activated to break off the power supply for the package. After the package is mounted perfectly, the power for the package is switched on by the action of the locking piece, thus preventing any misoperation when removing the package.

6 Claims, 9 Drawing Sheets

DATA PROCESSING DEVICE AND PLUG-IN PACKAGE

This is a Divisional of application Ser. No. 07/808,610, filed Dec. 17, 1991, now U.S. Pat. No. 5,343,009.

BACKGROUND OF THE INVENTION

1. Field of the Invention

This invention relates to a plug-in package, and more particularly to a data processing device equipped with a plug-in package suitable for safely exchanging a faulty package with a new one in a fault tolerant data processing device.

2. Description of the Related Art

The prior technology for exchange of a plug-in package with another without breaking off the power supply to a data processing device is exemplified by Japanese Patent Publication (KOKOKU) No. 31240/1984, which discloses a concept of connecting a power cable from an external power supply only during the exchange operation, Japanese Patent Laid-Open Publication (KOKAI) No. 108519/1976, which discloses a concept of varying the length of power supply terminals to provide a slight time lag when supplying power to a package, and Japanese Patent Laid-Open Publication (KOKAI) No. 153899/1988, which discloses a concept of causing high-impedance outputs of three-state buffer circuits by utilizing a package removing lever.

With the technology disclosed in Japanese Patent Publication No. 31240/1984 and Japanese Patent Laid-Open Publication No. 153899/1988, normal operations cannot be guaranteed when the package is removed without first connecting the power cable or when the package is removed without using the package removing lever. These prior publications do not mention any measures to be taken against any possible misoperation by the operator; a misoperation would damage the package, such as by melting and damaging the power supply terminal portion and would be a cause of noise interference to signals of another package in action. As long as only the technology of Japanese Patent Laid-Open Publication No. 108519/1976 is used, a very reliable package exchange cannot be achieved.

SUMMARY OF THE INVENTION

It is therefore an object of this invention to provide a data processing device and a plug-in package, whereby a faulty package can be exchanged with a new one without causing any misoperation.

According to a first aspect of this invention, there is provided a data processing device comprising: a plug-in package having a package removing lever; a mounting unit for mounting the plug-in package thereon; the plug-in package having a locking means for mechanically locking the package removing lever, and a switch means adapted to be activated, in response to the release operation of the locking means, for generating a power-off request; and the mounting unit having means for stopping supply of power to the plug-in package in response to the power-off request from the switch means.

Preferably, the package removing lever is constructed so as to prevent the locking means from returning to the lock position when the package removing lever is located out of the lock position after the package removing lever is released from the locking means.

The plug-in package further may have means for posting to the data processing device a plug-in package remove request on behalf of an operator, and means for posting to the operator a package removal permitted signal from the data processing device.

The posting means performs the posting by issuing an interrupt request to the processor of the data processing device, and the processor performs interrupt processing for stopping the supply of power to the plug-in package, in response to the interrupt request, and then outputs the package removal permitted signal to the plugin package.

The switch means is a switch having a contact movable between a closed state and an open state, the contact being releasable in response to the release operation of the locking means.

According to a second aspect of the invention, there is provided a data processing device comprising: a plug-in package; a mounting unit for mounting the plug-in package thereon; the plug-in package having a locking means for mechanically locking the plug-in package in a mounted state, and a switch means adapted to be activated, in response to the release operation of the locking means, for outputting a release signal; the mounting unit having means for stopping the supply of power to the plug-in package in response to the release signal from the switch means; and the plug-in package being adapted to be removed in two operations which include a release operation and a remove operation in this order.

According to a third aspect of the invention, there is provided a plug-in package comprising: a package removing lever; a locking means for mechanically locking the package removing lever; and a switch means adapted to be activated in response to the locking operation of the locking means; wherein in response to the release operation of the locking means, an output of the switch means is outputted as a power-off request which requests stopping of power supply to the plug-in package.

In operation, when removing a package, the locking piece is released to break off the power to the package, so that the package removing lever can be operated. When mounting a package, the power source is turned on by setting the locking piece upon completion of the mounting operation. Thus the package is removed in two operations which include a release operation and a remove operation in this order. A predetermined time difference is necessarily taken between these two operations so that the output of the power source can be reduced, thus preventing the package from being removed by misoperation before the output of the power source is broken off.

Since the package removing lever has such a shape that it will be prevented from being relocked after having being released, it is possible to ensure that the break-off of the power source is maintained.

Further, since the package has means for posting to the data processing device a plug-in package remove request on behalf of the operator, and means for posting to the operator a package removal permitted signal from the data processing device, it is possible to perform the package removal operation after proper programming process has been completed.

DETAILED DESCRIPTION OF THE PREFERRED EMBODIMENTS

Various embodiments of this invention will now be described with reference to the accompanying drawings.

Figure 2:
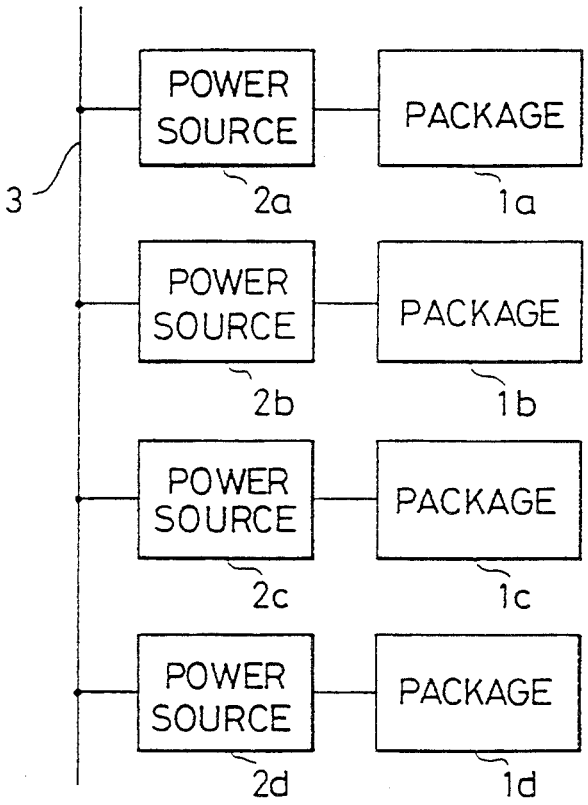
FIG. 2 is a block diagram showing a main portion of a data processing device embodying the invention.

FIG. 2 shows the relevant portion of a data processing device according to this invention. To each package 1*a*–1*d*, power is supplied from an input power cable 3 via the respective power source 2*a*–2*d*. An a.c. voltage of, for example, 200 volts is supplied from the input power cable 3, and a d.c. voltage needed for each package 1 is obtained by the respective power source 2*a*–2*d*. Each of the power source 2*a*–2*d* is a known switching regulator, for example.

For supplying power to packages from power sources, there is known a so-called output match method in which a.c.-d.c. conversion is performed by two large power sources and diodes are inserted into their respective output terminals. When a current to be consumed by the system is small, e.g., when the number of packages in the system is small, this method is used; however, if the current to be consumed is large, there is currently no diode that is stable in output voltage and hence suitable for output matching. To this end, there are a plurality of power sources each associated with each plug-in unit in this embodiment, although the present invention is not limited to this particular embodiment.

Figure 1:
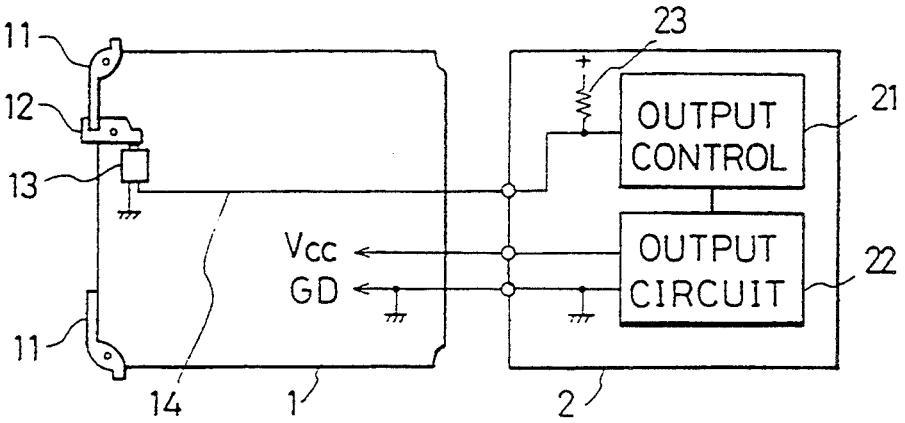
FIG. 1 is a diagram showing a package removing mechanism according to a first embodiment of this invention.

FIG. 1 shows a set of package 1 and power source 2 in the entire system of FIG. 2. As illustrated in the drawings the plug-in package 1 is an electric circuit module or board which is adapted to fit into a slot of a mounting unit 4 of a data processing device and is operable with power supplied from power source 2 of the device to which it is connected when plugged in. The package 1 includes a package removing lever 11, a locking piece 12 for mechanically locking the lever 11, and a push switch 13 operatively connected with the locking piece 12. The output of the switch 13 is inputted to the power source 2. In the power source 2, there are an output control circuit 21 for receiving the output of the switch 13, and an output circuit for supplying/stopping an operating voltage to the package 1 in response to the output of the output control circuit 21. The output circuit 22 is, for example, a switching regulator; the oscillator of the switching regulator is de-energized by the output of the output control circuit 21 to break off the power supply to the package. Alternatively, a relay may be mounted on the output terminal of the output circuit 22. Although it is not illustrated in the drawing, an electrical connector is inserted between the package 1 and the power source 2.

Figure 3A:
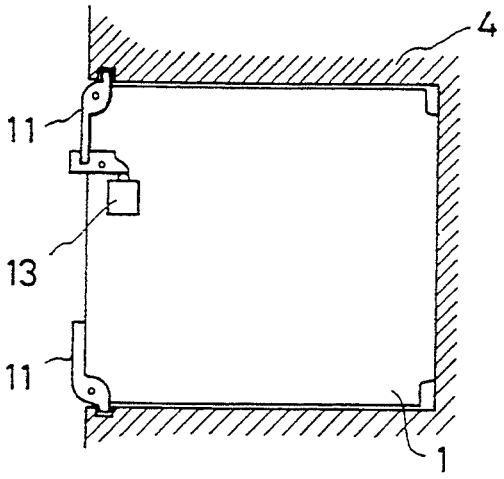
FIGS. 3A, 3B, 4A and 4B show the package removal operation of the mechanism of FIG. 1.
Figure 3B:
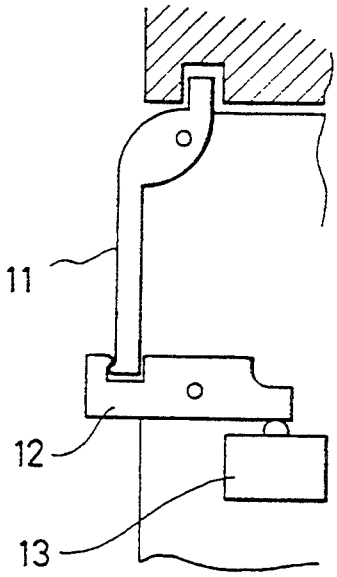
Figure 4A:
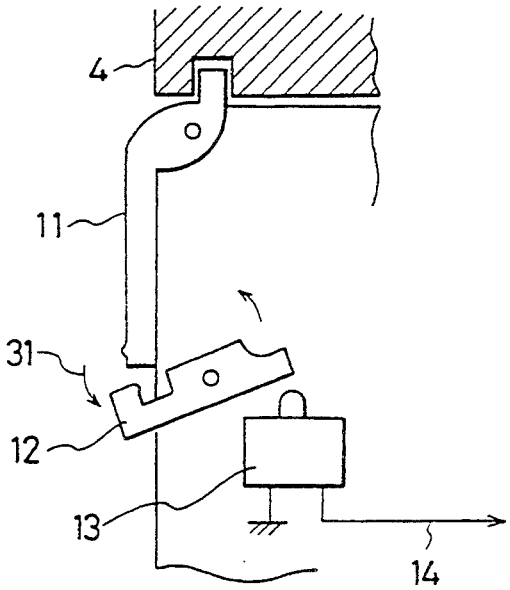
Figure 4B:
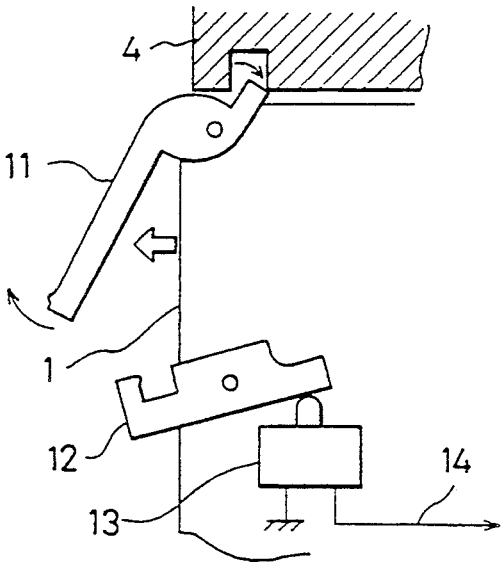

As shown in FIGS. 3A and 3B, when the package 1 is mounted in the mounting unit 4, the package removing lever 11 is held in locked position by the locking piece 12 so that the package 1 is prevented from being removed by mistake. As shown in FIG. 4A, in the package removing operation the locking piece 12 is angularly moved, in the direction indicated by an arrow 31, to release the lever 11. In response to the angular movement of the locking piece 12, the contact of the switch 13 is released to send a power-off request to the output control circuit 21 of the power source 2. Upon this release, since the contact of the switch 13 will be open, the signal line of the power-off request 14 will become, high by means of a pull-up resistor 23 (FIG. 1). The output control circuit 21 stops the operation of the output circuit 22 in response to the power-off request to break off the supply voltage to the package 1. Then, a pair of levers 11, shown in FIG. 1, are angularly moved. This causes the edges of the grooves of the unit 4 to be pushed to remove the package 1. This action and one of the levers are illustrated in FIG. 4B.

The method of operation for mounting the package will now be described. Before the package 1 is inserted, the power-off request 14 of the output control circuit 21 remains high by means of the pull-up resistor 23 in the power source 2, and the output of the power source 2 is off. In this situation, the lever 11 is angularly moved in order to insert the package 1. Subsequently setting the locking piece 12 will cause, the contact of the switch 13 to be closed so that the power-off request is prevented from being transmitted to the output control circuit 21, thus activating the output circuit 22 to supply the power to the package 1.

In this embodiment, the package is removed in two operations by the operator, i.e. releasing the locking of lever 11 and then manipulating the lever 11 to remove the package 1. Thus, before manipulating the lever 11, it is absolutely necessary to release the locking of the lever 11, there being a time difference between these two operations. Therefore, the time needed to allow the output of the power source 2 to be lowered can be secured so that the package 1 is prevented from being removed in error before the power supply is broken off.

Figure 5A:
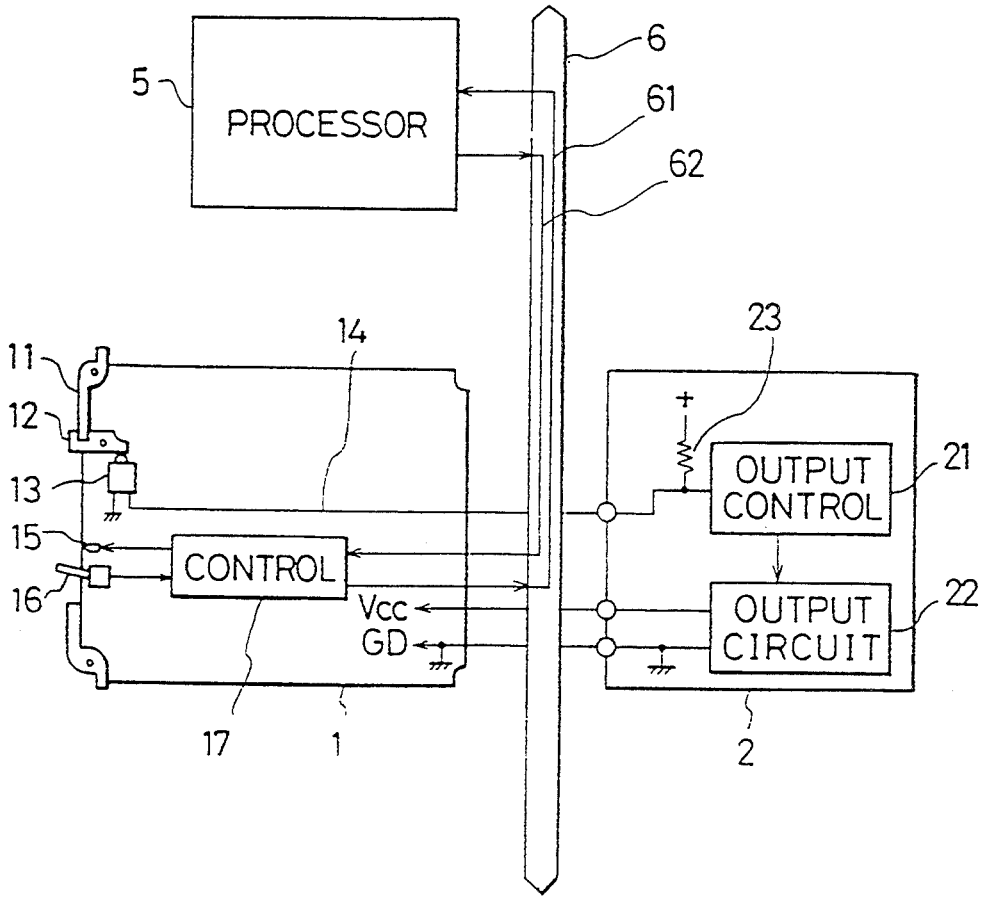
FIG. 5A is a diagram showing a second embodiment of the invention.

There are different kinds of packages for which the locking piece should not be released to break off the power supply suddenly during operation. FIG. 5A shows another embodiment applied to such a package. In this embodiment, there are in the package 1 a remove request switch 16 (toggle switch in this case), a control circuit 17 and a remove permission indicator 15. In FIG. 5A, an input/output bus 6 and a processor 5A are also shown.

In this embodiment, when removing the package 1, the operator brings the remove request switch 16 into its remove request position. In response to this manipulation, the control circuit 17 issues a remove request command 61 to the processor 5 to generate a remove request interrupt to the processor 5 via the input/output bus 6. Upon receipt of this interrupt command, the processor 5 issues a remove permission command 62 to the control circuit 17 via the input/output bus 6 after the remove is permitted by interrupt processing, thus turning on the remove permission indicator 15 (e.g., LED). After recognizing that the indicator 15 is turned on, the operator releases the locking point 12 and removes the package 1 by operation of the lever 11. Likewise in the embodiment of FIG. 1, the power-off of the package 1 is guaranteed before being removed. The purpose of the remove permission indicator 15 is to give notice of a remove permission to the operator; it should therefore by no means be limited to a visual indication and may be an audible indicator such as a buzzer.

Figure 5B:
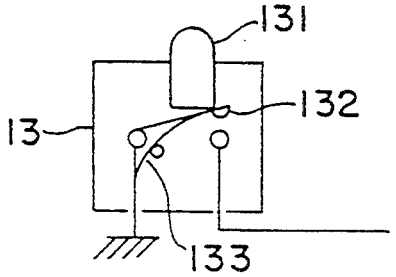
FIG. 5B is an enlarged, schematic view of the switch 13 shown in FIG. 5A.

The push button switch 13 of the described embodiments is shown enlarged and schematically in FIG. 5B. As seen therein push button 131 can be depressed against the bias of leaf spring 133 to move contact 132 and close the switch.

Figure 6:
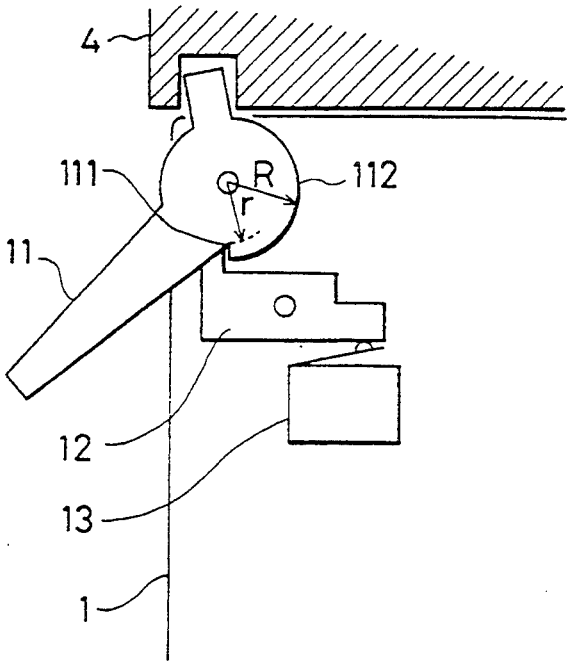
FIG. 6 is a diagram showing a modified locking piece.
Figure 7A:
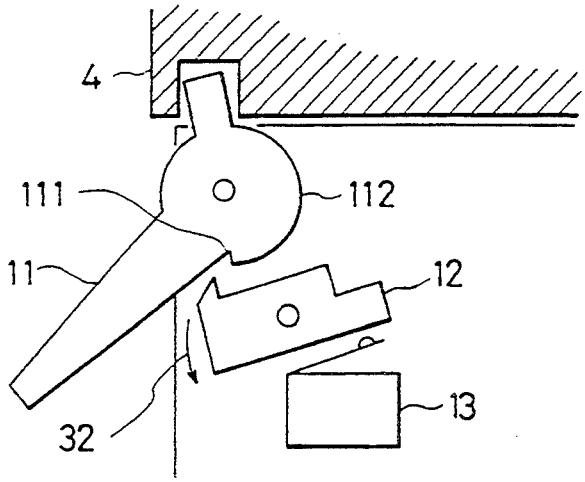
FIGS. 7A and 7B show the operation of the locking piece of FIG. 6.
Figure 7B:
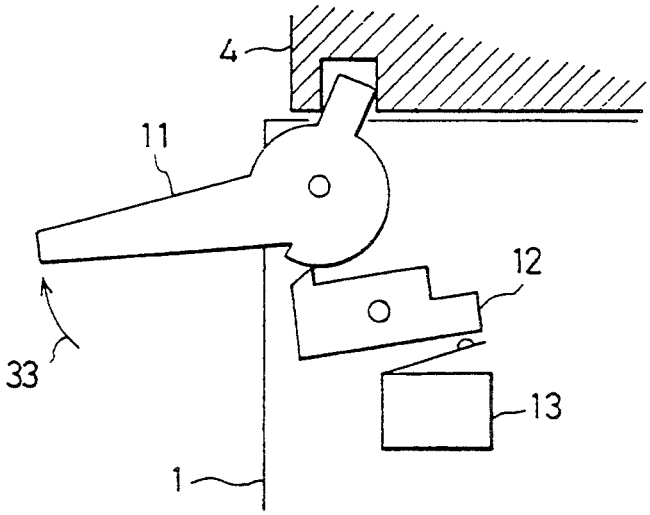

FIG. 6 shows another embodiment of the locking piece 12. A claw of the locking piece 12 is locked in a groove 111 of the lever 11 to cause the switch 13 to be closed by the locking piece 12. The radius R of a turning base portion 112 of the lever 11 is larger than the length r of the groove 111. When the lever 11 is angularly moved in the direction of an arrow; 32 as shown in FIG. 7A after the locking piece 12 is angularly moved in the direction of an arrow 32 to release the lock of the lever 11 as shown in FIG. 7A, the locking piece 12 continues assuring its release position so that the power source is prevented from being powered on such as when the locking piece 12 is contacted by the operator's hand while mounting/removing the package 1.

Figures 8A, 8B:
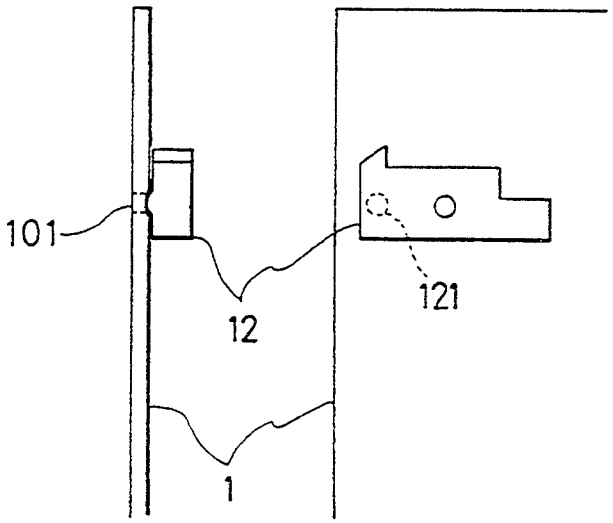
FIGS. 8A, 8B and 8C show how the locking piece of FIG. 6 is secured.
Figure 8C:
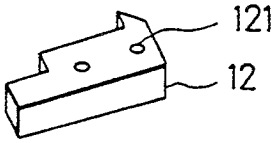

The means for preventing the locking piece 12 from being unlocked by mistake while the power is being supplied to the package 1, will now be described. The locking piece 12, as shown in FIG. 8C, has a projection 121 at a portion adapted to face the package 1 when assembled, and the package 1 has a hole 101 adapted to receive the projection 121 of the lock piece 12. As shown in FIGS. 8A and 8B, when locking, the projection 121 is engaged in the hole 101 and is kept immovable. The locking piece 12 can be released by simply pushing downwards. To ensure these actions, the locking piece 12 may be provided with a spring (not shown) normally urging the locking piece 12 against the surface of the package 1. While the lever 11 is being-locked (i.e., while the power is being supplied to the package 1), since the locking piece 12 itself is located behind the lever 11 (e.g., as shown in FIG. 7A), it is possible to prevent the power supply from being stopped as the lever 11 is released when the operator's hand accidentally contacts the locking piece 12.

Figure 9:
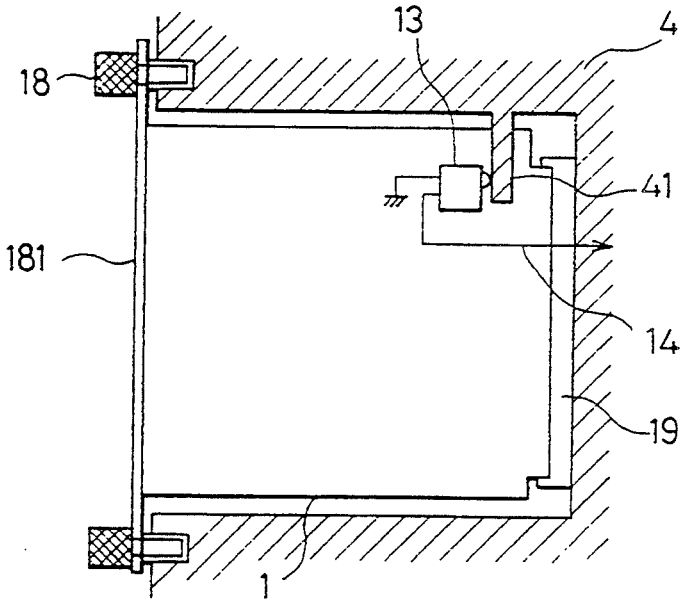
FIG. 9 is a diagram showing a third embodiment of the invention.

FIG. 9 shows still another embodiment in which sufficient time between the sending out of a power-off request and the removing of the package 1 is secured. In this embodiment, the package cannot be removed until each screw is turned several times.

The package 1 is fixed to the unit 4 by a pair of screws 18 and can be removed by turning the screws 18. The unit 4 has a finger-like projection 41 centrally therein; the mutual positions of the projection 41 and the switch 13 are such that when the package 1 is inserted into the unit 4, the switch 13 is activated after a connector 19 is engaged. When the package 1 is to be removed, the screws are turned. When each of the screws 18 is turned several times, the switch 13 is spaced away from the projection 41 to open the contact and stop the power supply to the package 1. This action corresponds to the release operation according to the embodiment of FIG. 1. When each of the screws have been turned several times, the connector is unlocked. The number of turns of each screw is usually such that the screws must be gripped and turned and regripped and turned further for removing the screws. This allows adequate time between the break-off of power and the removal of the package. This connector release corresponds to the package removal of the embodiment of FIG. 1. Thus, also in this embodiment, the package removal requires two operations by the operator, i.e. releasing the locking piece and then actually removing the package.

FIGS. 10A through 10D show a further embodiment of this invention.

Figure 10A:
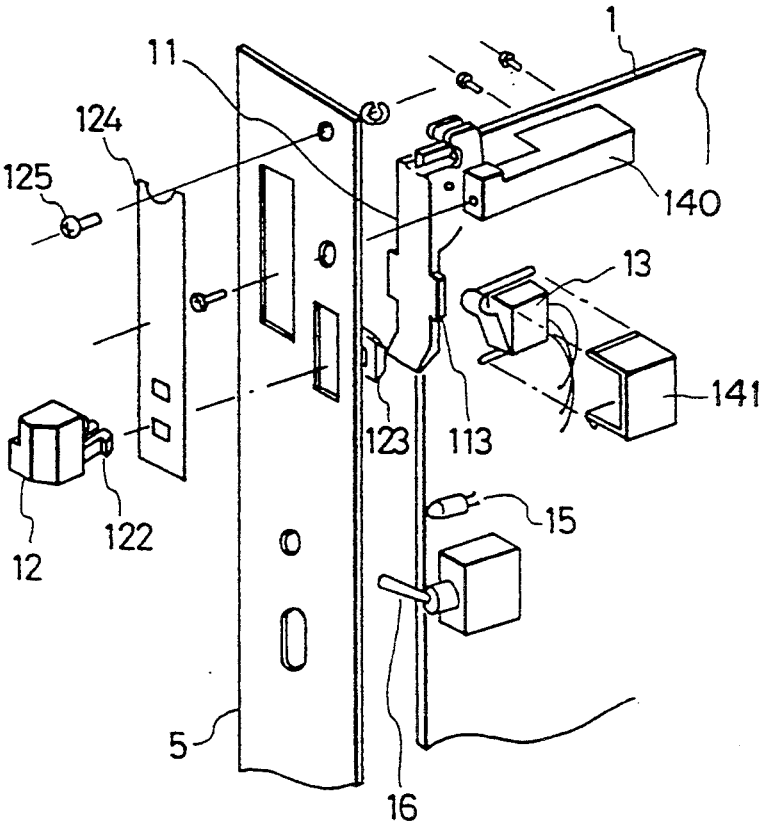
FIGS. 10A through 10E are diagrams showing a fourth embodiment of the invention.
Figure 10E:
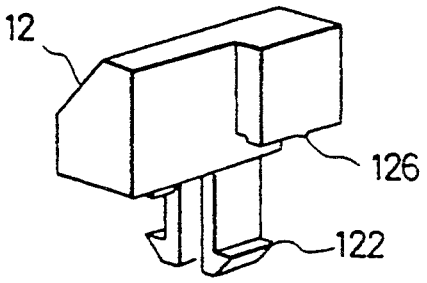
Figure 10D:
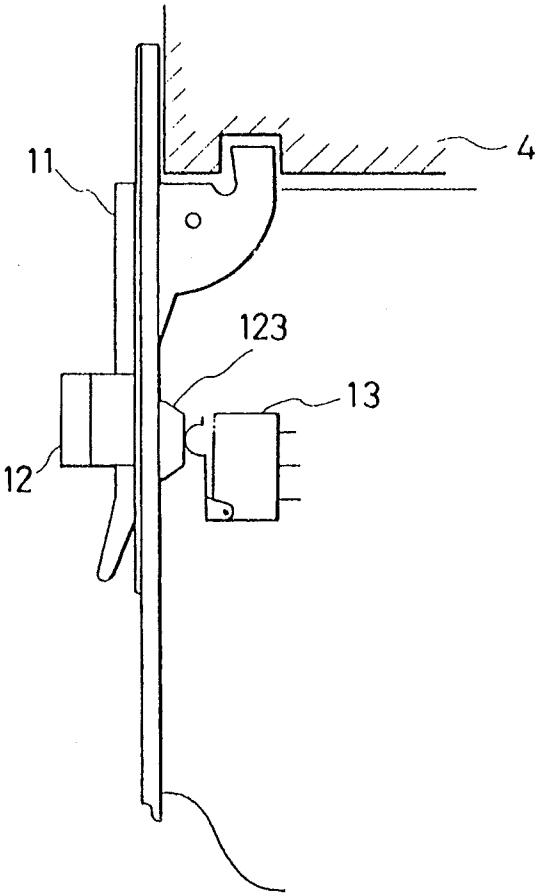
Figure 10C:
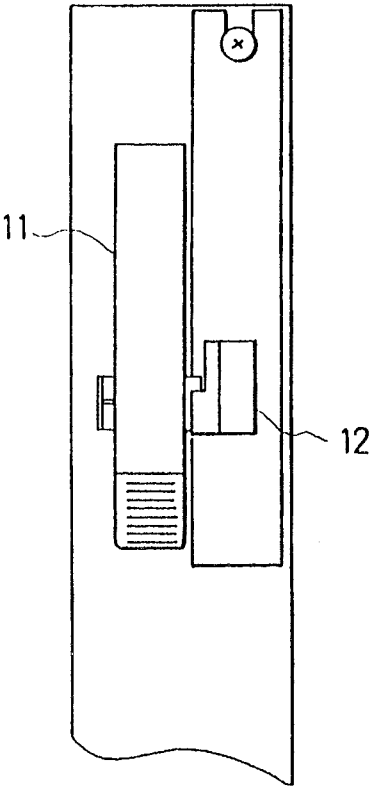

In this embodiment, the package removing lever 11 has a pair of lugs 113. The claws 122 integral with the locking piece 12 lock a slide block 123 through openings of a slide panel 124 and a package panel 5. A panel holder 140 on package 1 is for holding or supporting panel 5. As the locking piece 12 is moved up and down to an upper position and a lower position, the slide block 123 activates the switch 13 on and off as shown in FIG. 10D. A switch cover 141 fixes the switch 13 onto package 1.

Figure 10B:
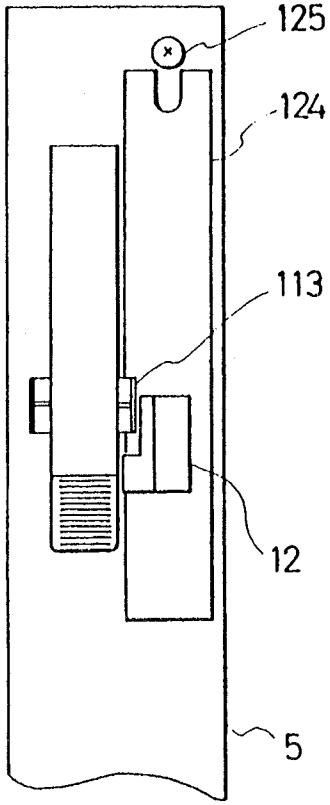

When inserting the package into the unit, the operator should hold the package removing lever 11. At that time the locking piece 12 assumes its lower (release) position as shown in FIG. 10B. With the locking piece 12 in the release position, the lever 11 is angularly moved. The locking piece 12 has a projection 126 engageable with the lug 113 of the lever 11. When inserting the package into the unit, these portions 113 and 126 do not engage each other so that the lever 11 can be freely turned. As the locking piece 12 is moved to the upper (lock) position after the package is inserted, the slide block 123 comes into contact with the operating lever of the switch 13 to cause the switch 13 to be turned on. The slide panel 124, which is integral with the locking piece 12, slides to the upper position, and then the upper groove of the slide panel 124 comes into engagement with a panel fastening screw 125. In this state, the lug 113 of the lever 11 comes into engagement with the projection 126 of the locking piece 12, and is fixed at this position by means of the screw 125.

When removing the package from the unit, the panel fastening screw 125 is loosened, and then the locking piece 12 is moved to the lower (release) position, thus causing the switch 13 to be turned off. Then the lever 11 is angularly moved to remove the package from the unit.

In this embodiment, since the lever 11 has the lugs 113, the lever 11 is used commonly at both the upper and lower sides of the package 1, in the same manner as that shown in FIG. 3A. Alternatively, each of the lugs 113, and the projection 126 may have a small projection so that the package 1 can be mounted in the unit 4 in a snap action. In another alternative form, the projection 126 of the locking piece 12 may have an increased height so that when the package 1 is inserted into the unit 4, the lug 113 of the lever 11 comes into engagement with the projection 126 of the locking piece 12 to prevent the package 1 from being inserted by mistake with the locking piece 12 in the lock position and also with the switch 13 in the on state.

According to this embodiment, since the panel fastening screw 125 is used, it is possible to perform the lock operation reliably and precisely.

As described above, according to this embodiment, when a plug-in package is exchanged with a new one without breaking off the power supply of the whole data processing device, the certain prevention of accidental plug-in package removal while maintaining the power supply to the package is achieved.

What is claimed is:

1. A data processing device comprising:

a plug-in package including an electronic circuit module which is adapted to fit into a slot of the data processing device and is adapted to be operable with power supplied from a power source of the device, said package having a package removing lever mounted thereon for manually removing said package from said device;

a mounting unit with said slot for mounting said plug-in package thereon;

said plug-in package further including a releasable locking means for mechanically locking said package removing lever so as to prevent movement of said lever and removal of said package from said device without first manually releasing said locking means from a locked position;

said package removing lever including means for preventing said lever from returning to a lock position where said lever can be locked when a lock of the lever by the said locking means is released and the lever is not at the locked position.

2. A data processing device according to claim 1, wherein said plug-in-package includes a switch means adapted to be activated, in response to a release operation of said locking means, for generating a power-off request; and said mounting unit has means for stopping supply of power to said plug-in package in response to the power-off request from said switch means.

3. A data processing device comprising;

a plug-in package including an electronic circuit module which is adapted to fit into a slot of the data processing device and is adapted to be operable with power supplied from a power source of the device, said package having a package removing lever mounted thereon for manually removing said package from said device;

a mounting unit with said slot for mounting said plug-in package thereon;

a processor for executing data processing to determine whether said plug-in package may be removed or not, and output a removal permission command in the case when said plug-in package may be removed;

a bus for transmitting and receiving a command between said plug-in package mounted on said mounting unit, and said processor;

said plug-in package further including;

a releasable locking means for mechanically locking said package removing lever so as to prevent movement of said lever and removal of said package from said device without first manually releasing said locking means from a locked position;

a means for transmitting a removal request command of said plug-in package via said bus by an operation by an operator; and a removal permission notice means for notifying the operator of removal permission after the removal permission command has been received via said bus when said processor outputs said removal permission command in response to the removal request command to said processor.

4. A data processing device according to claim 3, wherein said processor executes an interrupt processing for breaking off the power supply to said plug-in package in response to said removal request command, and outputs said removal permission command based on a determination that said plug-in package may be removed after completion of said interrupt processing.

5. A data processing device according to claim 3, wherein said plug-in package includes a switch means adapted to be activated, in response to a release operation of said locking means, for generating a power-off request; and said mounting unit has means for stopping supply of power to said plug-in package in response to the power-off request from said switch means.

6. A data processing device according to claim 4, wherein said plug-in package including a switch means adapted to be activated, in response to a release operation of said locking means, for generating a power-off request; and said mounting unit has means for stopping supply of power to said plug-in package in response to the power-off request from said switch means.

* * * * *